US010290171B2

(12) United States Patent
Yokota

(10) Patent No.: US 10,290,171 B2
(45) Date of Patent: May 14, 2019

(54) AUTOMATIC VENDING MACHINE

(71) Applicant: FUJI ELECTRIC CO., LTD., Kawasaki-shi, Kanagawa (JP)

(72) Inventor: Yoshitake Yokota, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 23 days.

(21) Appl. No.: 15/858,250

(22) Filed: Dec. 29, 2017

(65) Prior Publication Data

US 2018/0211470 A1 Jul. 26, 2018

(30) Foreign Application Priority Data

Jan. 23, 2017 (JP) ..... 2017-009502

(51) Int. Cl.

| | |
|---|---|
| ***F25D 17/08*** | (2006.01) |
| ***G07F 9/10*** | (2006.01) |
| ***F25D 11/00*** | (2006.01) |
| ***F25D 17/04*** | (2006.01) |
| ***F25D 17/06*** | (2006.01) |

(52) U.S. Cl.

CPC ..... *G07F 9/105* (2013.01); *F25D 11/00* (2013.01); *F25D 17/045* (2013.01); *F25D 17/06* (2013.01); *F25D 17/08* (2013.01); *F25D 2317/0664* (2013.01); *F25D 2500/02* (2013.01)

(58) Field of Classification Search

CPC . G07F 9/10; G07F 9/105; F25D 11/10; F25D 17/08

USPC ..... 160/135; 121/150 R

See application file for complete search history.

(56) References Cited

U.S. PATENT DOCUMENTS

| | | | | |
|---|---|---|---|---|
| 4,307,286 A * | 12/1981 | Guibert | A23L 3/365 126/21 A |
| 5,181,883 A * | 1/1993 | Hofstra | A24F 47/00 454/343 |
| 6,701,739 B2 * | 3/2004 | Morse | F25D 19/00 62/277 |
| 8,806,885 B2 * | 8/2014 | Bae | F25D 17/065 62/407 |
| 9,373,210 B2 * | 6/2016 | Wittern, Jr. | F25D 17/065 |

(Continued)

FOREIGN PATENT DOCUMENTS

| | | | |
|---|---|---|---|
| JP | 2009175906 A * | 8/2009 | G07F 9/10 |
| JP | 2014222404 A * | 11/2014 | G07F 9/10 |
| JP | 5949381 B2 | 7/2016 | |

*Primary Examiner* — Rakesh Kumar

(74) *Attorney, Agent, or Firm* — Manabu Kanesaka

(57) ABSTRACT

An automatic vending machine includes: product storage shelves provided along an up-down direction in a product storage region inside a product storage; a back face duct configured to extend along the up-down direction behind the product storage region; a circulating unit configured to flow air inside the product storage into the back face duct from an air inlet of the back face duct to circulate the inside air between an inside of the product storage region and an outside of the product storage region; a temperature adjusting unit configured to adjust the inside air circulated by the circulating unit to a desired temperature; and a side face duct configured to extend along the up-down direction at a place corresponding to front end portions of the product storage shelves in at least one of both side regions of the product storage region, and communicate with the back face duct.

7 Claims, 18 Drawing Sheets

(56) References Cited

U.S. PATENT DOCUMENTS

| | | | | |
|---|---|---|---|---|
| 9,741,196 | B2 * | 8/2017 | Yamagami | G07F 9/105 |
| 2003/0230104 | A1 * | 12/2003 | Morse | F25D 19/00 62/277 |
| 2013/0284758 | A1 * | 10/2013 | Wittern, Jr. | F25D 17/065 221/150 R |
| 2014/0312053 | A1 * | 10/2014 | Yamagami | G07F 9/105 221/150 R |
| 2015/0206373 | A1 * | 7/2015 | Kim | G07F 9/10 221/1 |
| 2018/0112905 | A1 * | 4/2018 | Cho | F25D 17/062 |

* cited by examiner

AUTOMATIC VENDING MACHINE

CROSS-REFERENCE TO RELATED APPLICATION(S)

The present application claims priority to and incorporates by reference the entire contents of Japanese Patent Application No. 2017-009502 filed in Japan on Jan. 23, 2017.

BACKGROUND

1. Technical Field

The disclosure relates to an automatic vending machine that sells products.

2. Related Art

Automatic vending machines that sell products include automatic vending machines that send out products stored on product storage shelves of product storages therein onto transport trays, and thereafter transport the products on the transport trays and dispense the products to predetermined product take-out regions. The product take-out regions are spaces communicating with outside of the product storages via product take-out openings, and when users insert their hands from the product take-out openings, the users are able to take out the products they have purchased.

Normally, this type of automatic vending machine: has a front surface formed of a transparent face plate of glass or the like; allows products stored on product storage shelves of a product storage therein to be visually recognized and selected; and enables a user to observe how a product purchased by the user and sent out from the product storage shelves is transported to a product take-out region by a transport tray. Such automatic vending machines that allow inside of product storages therein to be visually recognized have advantages, including their ability to increase users' willingness to buy.

With respect to such automatic vending machines, an automatic vending machine has been proposed, for which uniformization of temperature inside a product storage therein is attempted by: provision of one left side face duct and one right side face duct along an up-down direction at both side portions of the product storage, that is, in both side regions of product storage shelves; and discharge of inside air that has been cooled, from respective discharge ports of the side face ducts (see, for example, Japanese Patent No. 5949381).

SUMMARY

In recent years, due to diversification of products sold, there is a demand for products at more than one temperature zone to be sold by automatic vending machines.

However, in the automatic vending machine proposed by Japanese Patent No. 5949381, since the uniformization of the temperature inside the product storage is attempted by the discharge of the inside air that has been cooled, from the respective discharge ports of the side face ducts; the products in the product storage are unable to be sold at more than one temperature zone.

In view of the above described actual circumstances, it is desirable to provide an automatic vending machine that is able to sell products on product storage shelves at more than one temperature zone as necessary.

It is an object of the disclosure to at least partially solve the problems in the conventional technology.

In some embodiments, an automatic vending machine includes: product storage shelves that are provided along an up-down direction in a product storage region inside a product storage defined in a main body of the automatic vending machine; a back face duct configured to extend along the up-down direction behind the product storage region; a circulating unit configured to flow air inside the product storage into the back face duct from an air inlet of the back face duct to circulate the inside air between an inside of the product storage region and an outside of the product storage region; a temperature adjusting unit configured to adjust the inside air circulated by the circulating unit to a desired temperature; and a side face duct configured to extend along the up-down direction at a place corresponding to front end portions of the product storage shelves in at least one of both side regions of the product storage region, and communicate with the back face duct. The circulating unit is configured to circulate the inside air by causing the inside air that has flown into the back face duct to enter the side face duct, and causing the inside air to be discharged to a front region including the front end portions of the product storage shelves from discharge ports provided at predetermined intervals along an extending direction of the side face duct, such that the discharged inside air passes backward after substantially spreading over the front region and flows into the back face duct from the air inlet. The automatic vending machine further comprises a restriction mechanism configured to: allow the inside air to be discharged from target discharge ports of the discharge ports when the restriction mechanism is in an open state, the target discharge ports being positioned downstream of air flow in the side face duct with respect to a predetermined position in a height direction of the side face duct; and restrict the inside air from being discharged from the target discharge ports when the restriction mechanism is in a closed state.

The above and other objects, features, advantages and technical and industrial significance of this disclosure will be better understood by reading the following detailed description of presently preferred embodiments of the disclosure, when considered in connection with the accompanying drawings.

BRIEF DESCRIPTION OF THE DRAWINGS

FIG. 12 is in the closed state;

DETAILED DESCRIPTION

Hereinafter, by reference to the appended drawings, a preferred embodiment of an automatic vending machine according to the disclosure will be described in detail.

Figure 1:
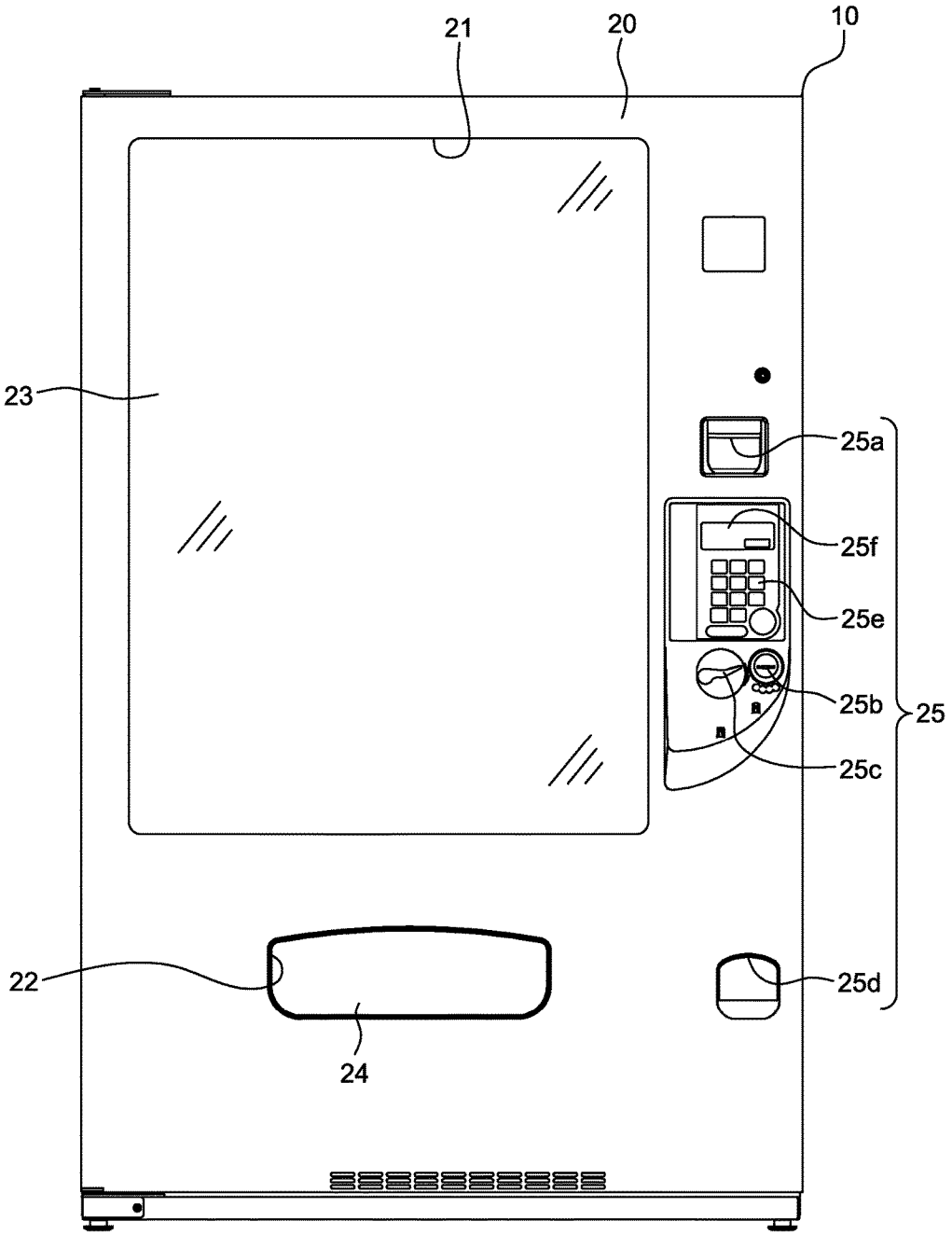
FIG. 1 is a front view illustrating an automatic vending machine that is an embodiment of the disclosure.
Figure 2:
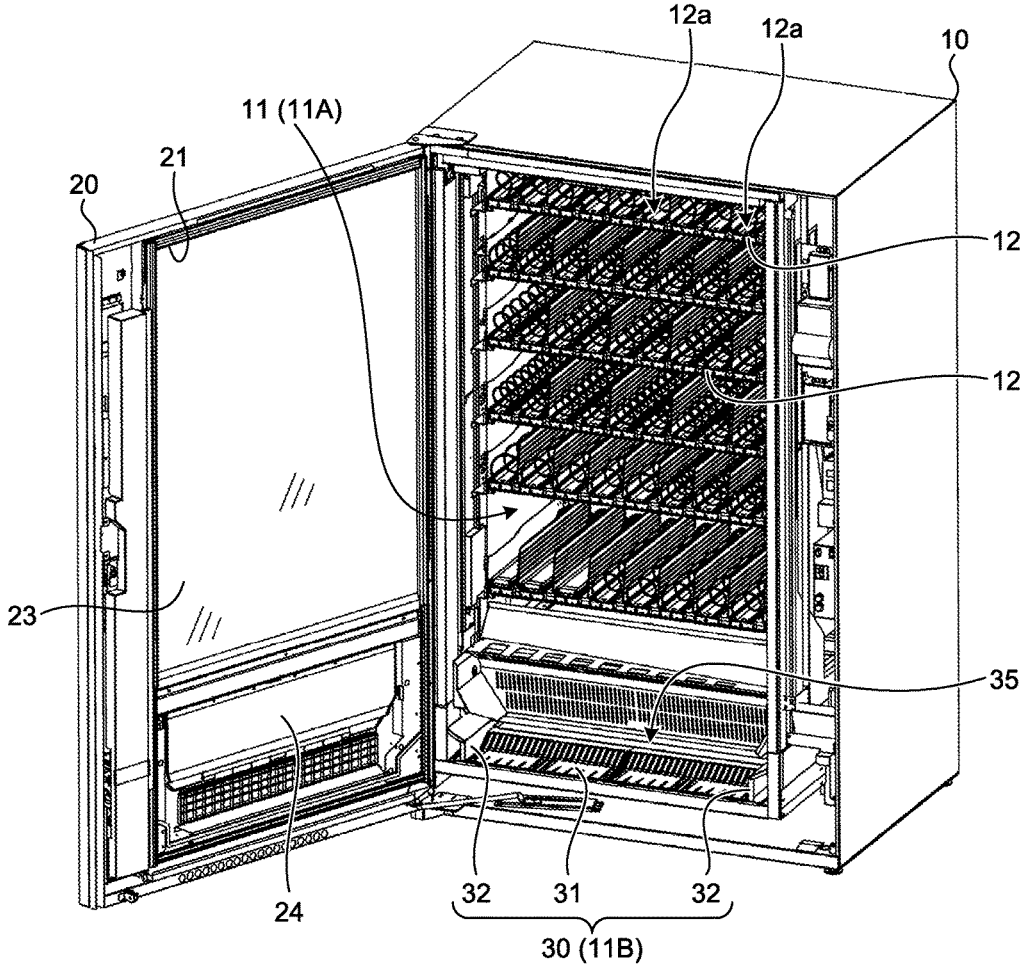
FIG. 2 is a perspective view illustrating a state where an external door of the automatic vending machine illustrated in FIG. 1 is open.

Each of FIG. 1 and FIG. 2 illustrates an automatic vending machine that is an embodiment of the disclosure. The automatic vending machine illustrated therein: is a general-purpose automatic vending machine that has fixed form products, such as products in containers and products in boxes, or unfixed form products, such as products in bags, as targets to be sold; and includes a main body cabinet 10 and an external door 20.

The main body cabinet 10 is a main body of the automatic vending machine, the main body having a box shape, with a front face thereof being open. The external door 20 is a door body having a flat plate shape with a large thickness dimension, and is held at one side portion of the main body cabinet 10 so as to open and close the front face opening of the main body cabinet 10. Although not clearly illustrated in the figures, each of the main body cabinet 10 and the external door 20 has a heat insulating function; and when the front face opening of the main body cabinet 10 is closed by the external door 20, the main body cabinet 10 and the external door 20 form a product storage 11 serving as a heat insulating space inside the main body cabinet 10.

A product storage region 11A in the product storage 11 of the main body cabinet 10 has product storage shelves 12 provided therein, which are in more than one stage along an up-down direction. Each of the product storage shelves 12 is: formed by more than one storage column 12*a* being placed side by side in a left-right direction, the more than one storage column 12*a* storing therein plural products along a front-back direction; and arranged in the product storage 11 in a state where front ends of the respective product storage shelves 12 are positioned in the same vertical plane (hereinafter, referred to as "dispensing plane").

The product storage shelves 12 are able to be arranged at arbitrary height positions in the product storage 11, and heights thereof are able to be set to be different from one another. Further, on each of the product storage shelves 12, widths of the storage columns 12*a* along the left-right direction are able to be set arbitrarily. Each of the storage columns 12*a* set on the product storage shelves 12 operates individually, and enables a product positioned at the front-most row to fall downward via the dispensing plane by sequentially sending out products stored therein forward. In this embodiment, the product storage shelves 12, which are referred to as a so-called spiral rack that is configured to sequentially send out the products in the storage columns 12*a* forward by rotation of spirals, are illustrated.

The product storage shelves 12 are not necessarily limited to those that send out the products by the rotation of the spirals, and for example, those configured to send out the products forward by drive of a transport conveyor may be applied as the product storage shelves 12.

As illustrated in FIG. 1, the external door 20 has a window portion 21 and a product take-out opening 22 provided therein. The window portion 21 is formed by arrangement of a plane material 23, which is made of multi-layered glass or the like, is transparent, and has a heat insulating property; and the window portion 21 enables products stored in the frontmost rows of all of the storage columns 12*a* of the product storage shelves 12 to be visually recognized from outside thereof, even when the front face opening of the main body cabinet 10 is closed by the external door 20. Although not clearly illustrated in the figures, identification numbers are set for the storage columns 12*a* and are displayed on front ends of the storage columns 12*a* such that the identification numbers are able to be visually recognized through the window portion 21.

The product take-out opening 22 is an opening for a user to receive a product purchased, and is formed at a position lower than the window portion 21 in the external door 20. An upper rim of the opening of this product take-out opening 22 is set to be positioned even lower than the product storage shelf 12 arranged at the lowermost stage. This product take-out opening 22 is normally in a closed state by a product take-out door 24 provided in the external door 20, and is able to be opened by the product take-out door 24 being pushed and turned inward. The product take-out door 24 is supported on the external door 20 via an upper end portion thereof by an opening and closing shaft, which is along the left-right direction and not illustrated in the figures, such that the product take-out door 24 is movable around a central axis of the opening and closing shaft. This product take-out door 24 opens the product take-out opening 22 by door opening operation backward (toward the main body cabinet 10), and closes the product take-out opening 22 by door closing operation forward. Although not clearly illustrating in the figures, at a portion positioned around the product take-out opening 22 in the external door 20, a gasket that prevents air inside and air outside the product storage 11 from circulating to each other through the product take-out opening 22 is arranged over the entire perimeter of a portion opposite to the product take-out door 24.

Further, in the external door 20 of the automatic vending machine, as illustrated in FIG. 1, an operation unit 25 is provided collectively in a part that is at a side of the window portion 21. The operation unit 25 is for a user to operate when the user uses the automatic vending machine, and includes a bill insertion slot 25*a*, a coin insertion slot 25*b*, a return lever 25*c*, a coin return opening 25*d*, an input portion 25*e*, and a display portion 25*f*. The bill insertion slot 25*a* is an opening for receiving bills, and the coin insertion slot 25*b* is an opening for receiving coins. The return lever 25*c* is operated when money is returned. The coin return opening 25*d* is a portion, from which returned coins or change are/is dispensed. The input portion 25*e* is for the user to specify a product to be purchased. In this embodiment, the input portion 25*e* is configured to include numeric keys, which become valid when money is inserted, and through which an identification number of the storage column 12*a* storing therein the product to be purchased is directly input. The display portion 25*f* is for displaying thereon input information input through the input portion 25*e*, and various pieces of information needed when the automatic vending machine is used, such as "available for purchase", the amount of money inserted, "short of change", and "bills not usable".

At a front end portion of the product storage region 11A in the product storage 11, a product take-out region 11B is secured. The product take-out region 11B is a lowermost space, to which a produce purchased by a user is finally transported, and is formed in a part that is on or lower than the upper rim of the product take-out opening 22 when the external door 20 is in a closed state.

This product take-out region 11B has a take-out guide 30 arranged therein. The take-out guide 30 is a dish shaped member for receiving a product dispensed to the product take-out region 11B, and is, as illustrated in FIG. 2, configured to include a bottom wall portion 31 and a pair of let and right side wall portions 32. This take-out guide 30: receives a product transported by a transport tray 35 that is movable along the up-down direction above the product take-out region 11B; and lets the product to be taken out from the product take-out opening 22 that has been opened.

Figure 3:
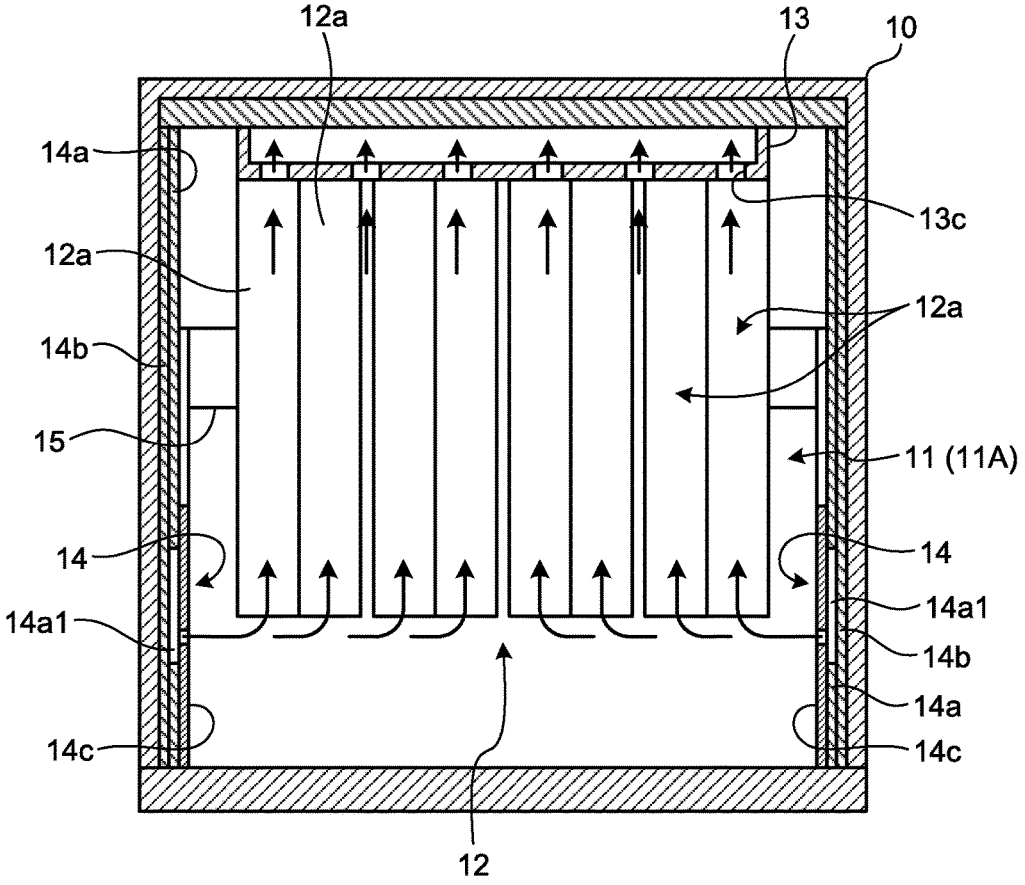
FIG. 3 is a transverse sectional view of the automatic vending machine illustrated in FIG. 1.
Figure 4:
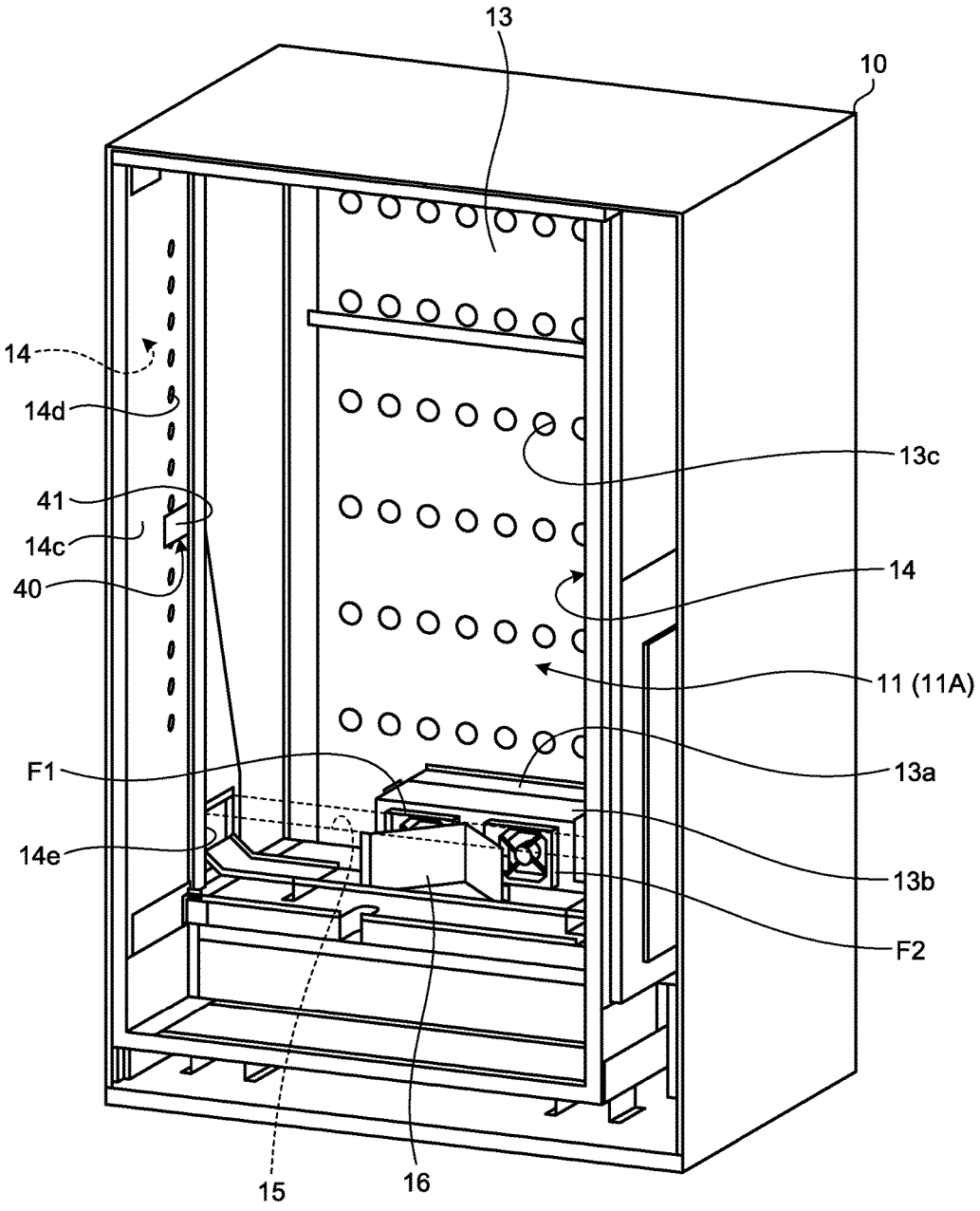
FIG. 4 is a perspective view illustrating an internal configuration of a main body cabinet of the automatic vending machine illustrated in FIG. 1.

FIG. 3 is a transverse sectional view of the automatic vending machine that is the embodiment of the disclosure, illustrated in FIG. 1 and FIG. 2, and illustration of the spirals of the storage columns 12*a* and the transport tray 35 is omitted therein. FIG. 4 is a perspective view illustrating an internal configuration of the main body cabinet 10 forming the automatic vending machine illustrated in FIG. 1 and FIG. 2, and illustration of the product storage shelves 12 and the transport tray 35 is omitted therein.

As illustrated in these FIG. 3 and FIG. 4, a back face duct 13 and side face ducts 14 are provided in the product storage 11 of the main body cabinet 10.

The back face duct 13 is provided to extend along the up-down direction behind the product storage region 11A of the product storage 11, that is, behind the product storage shelves 12. An air outlet (not illustrated in the figure) is provided at a lower front face of this back face duct 13, and a wind tunnel member 13*a* is arranged to cover the air outlet. This wind tunnel member 13*a*: connects an evaporator 13*b* arranged in front of the wind tunnel member 13*a* and the back face duct 13 together; and is for guiding air that has gone through the back face duct 13 and has been blown out from the air outlet to the evaporator 13*b*. The evaporator 13*b*: forms a refrigerating cycle that circulates a refrigerant enclosed therein, by being connected, through a refrigerant piping, to a compressor, a condenser, and the like, which are not illustrated in the figures; and is a temperature adjusting unit that cools and adjusts air that passes around the evaporator 13*b* to a desired cooling temperature, by evaporation of the refrigerant passing through a refrigerant passage of the evaporator 13*b*. Inner blower fans F1 and F2 are placed side by side in the left-right direction in front of this evaporator 13*b*. These inner blower fans F1 and F2 are a circulating unit that circulates the air inside the product storage 11 inside and outside the product storage region 11A by being driven.

More than one air inlet 13*c* is provided in the back face duct 13. The air inlets 13*c* are openings for the air inside the product storage 11 to be drawn in when the inner blower fans F1 and F2 are driven. These air inlets 13*c* are formed at places not blocked by the product storage shelves 12 when the product storage shelves 12 are installed.

Figure 5:
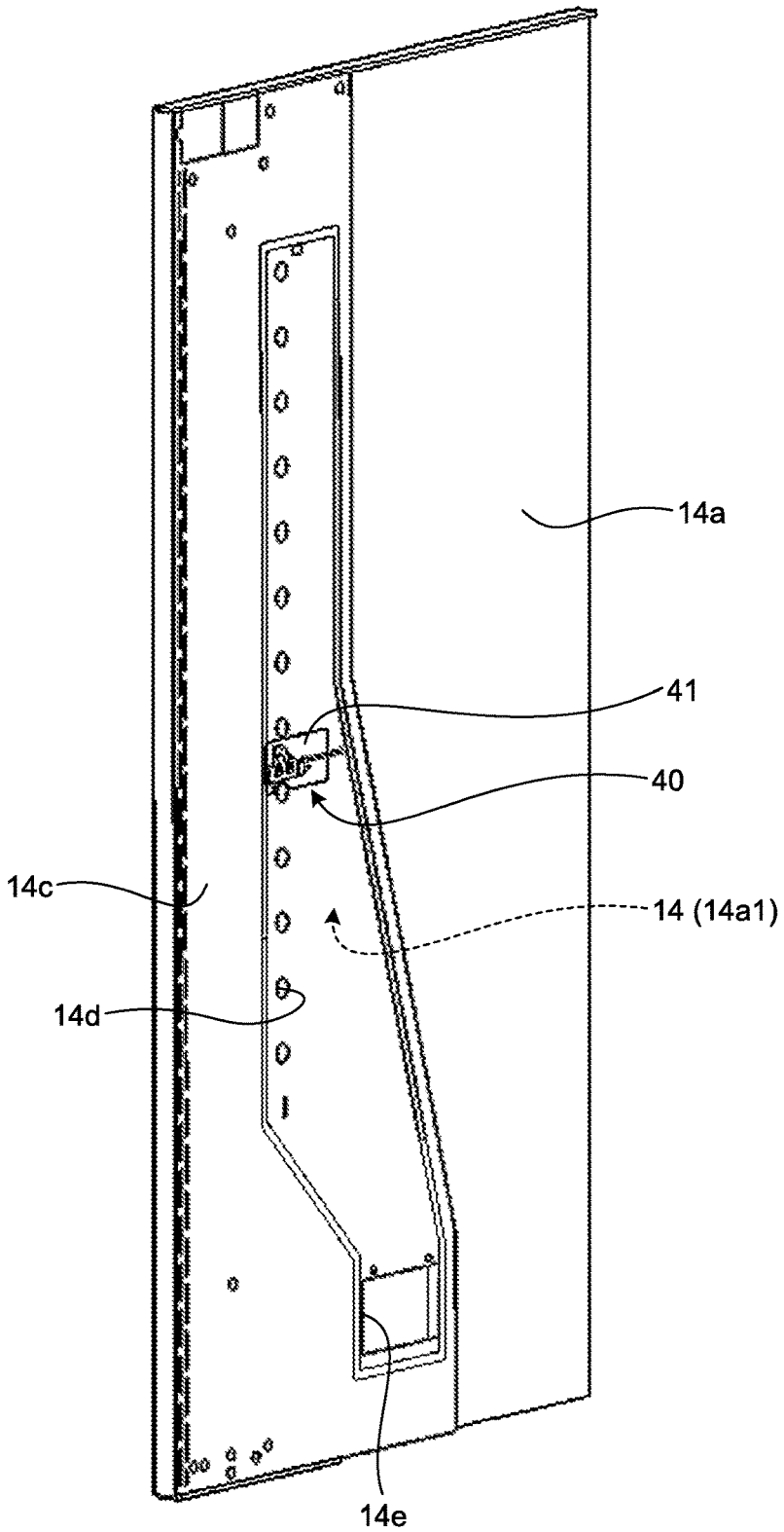
FIG. 5 is a perspective view illustrating a configuration of a side face duct on the left side.
Figure 6:
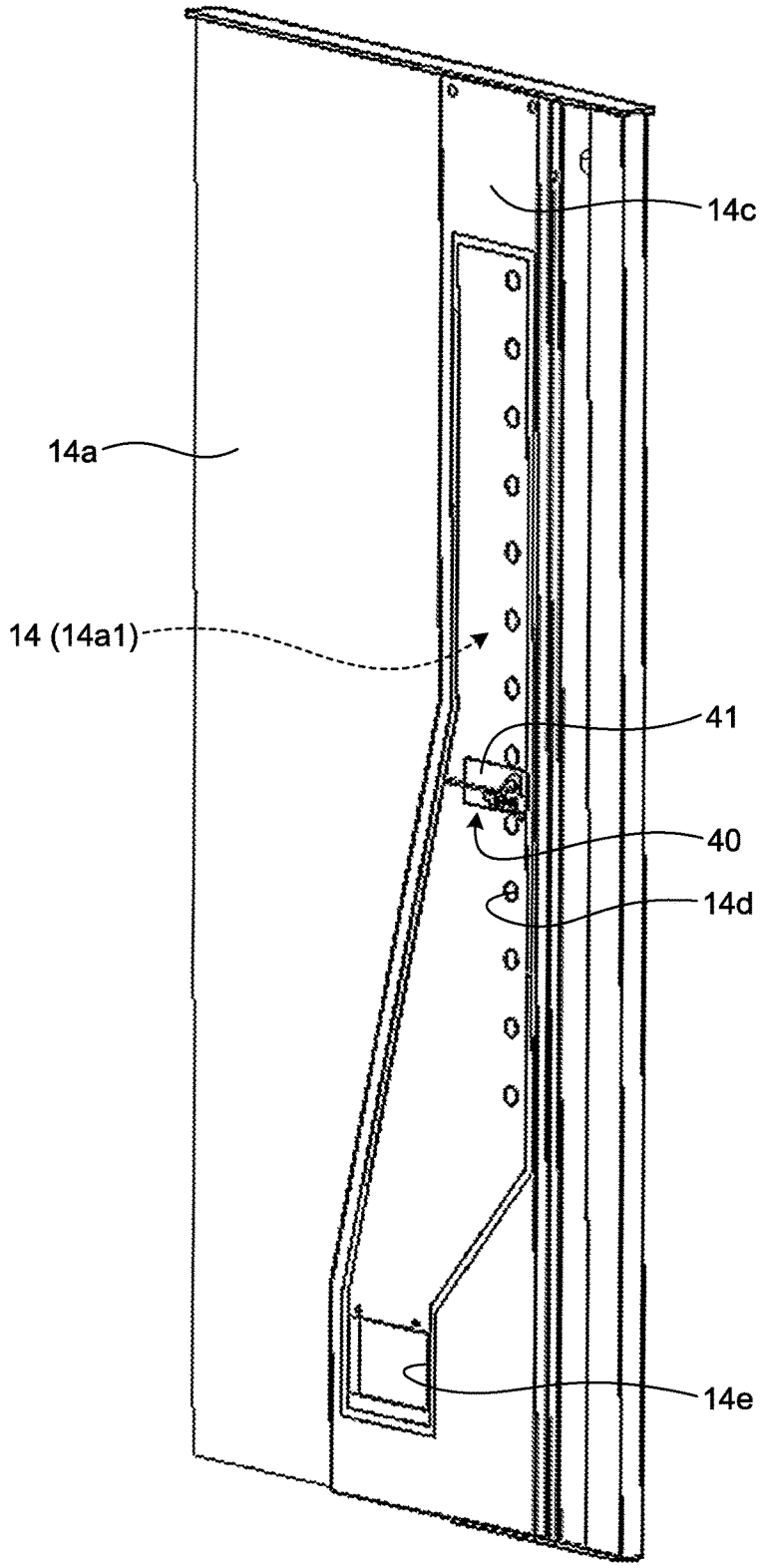
FIG. 6 is a perspective view illustrating a configuration of a side face duct on the right side.

The side face ducts 14 extend along the up-down direction at places corresponding to front end portions of the respective product storage shelves 12 in both side regions of the product storage region 11A of the product storage 11; and as illustrated in FIG. 5 and FIG. 6, the side face ducts 14 are made up of a pair of left and right side face ducts.

Figure 7:
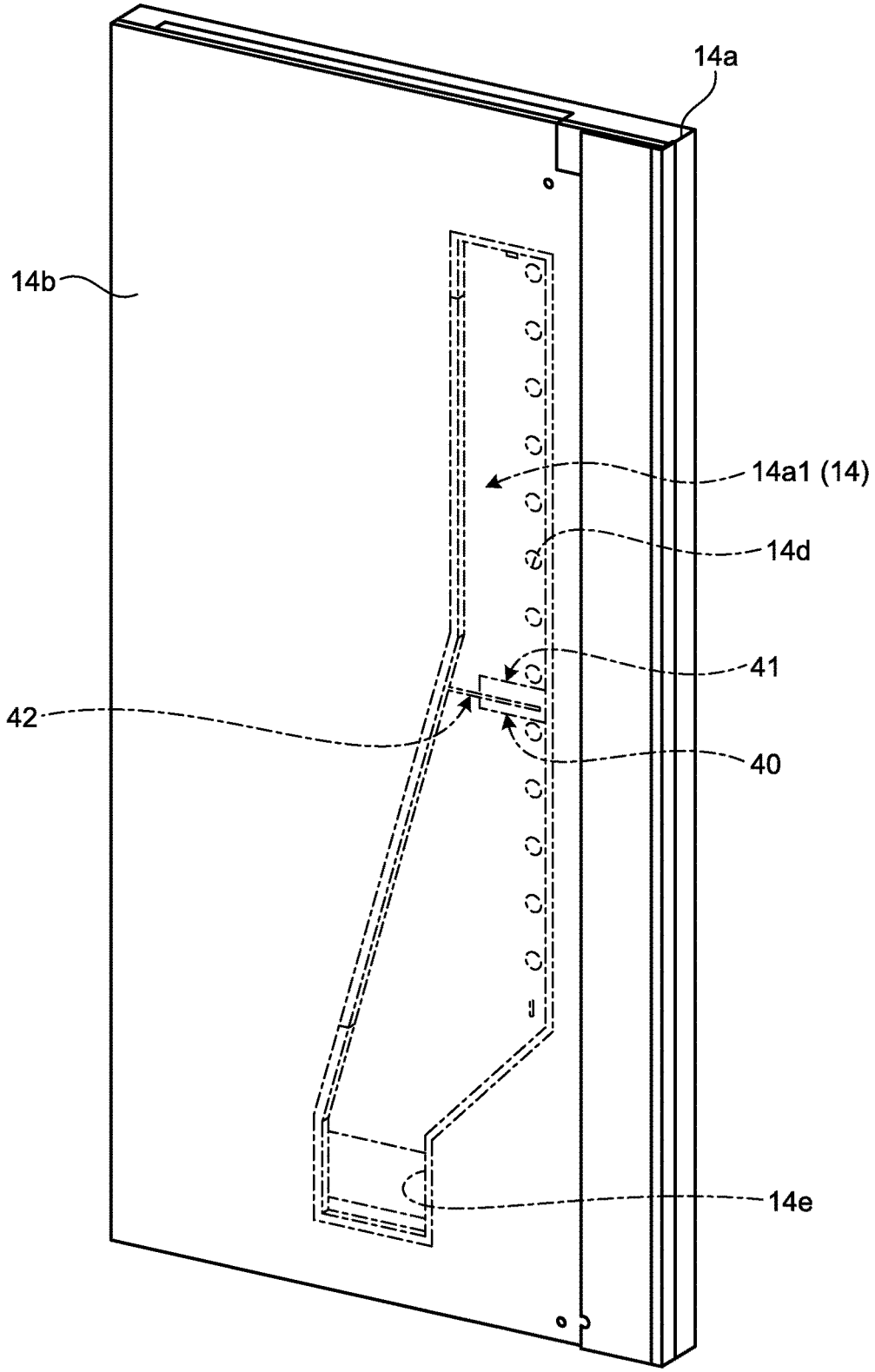
FIG. 7 is a perspective view illustrating the configuration of the side face duct on the left side illustrated in FIG. 3 as viewed from outside.
Figure 8:
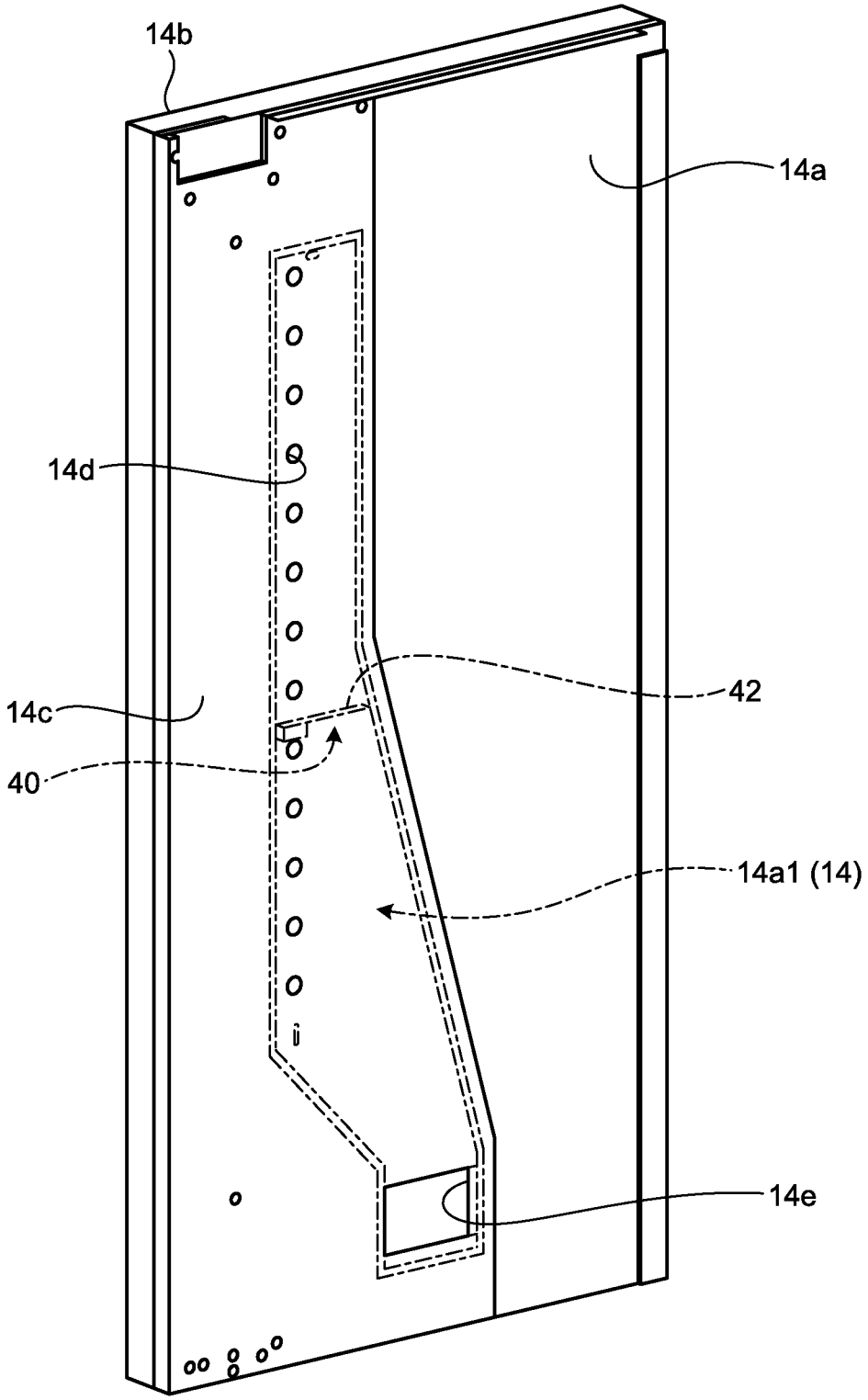
FIG. 8 is a perspective view illustrating the configuration of the side face duct on the left side illustrated in FIG. 3 as viewed from inside.

Each of FIG. 7 and FIG. 8 is a diagram for illustration of a configuration of the side face duct 14 on the left side, FIG. 7 is a perspective view illustrating a case where the side face duct 14 is viewed from outside the storage, and FIG. 8 is a perspective view illustrating a case where the side face duct 14 is viewed from inside the storage. Hereinafter, the side face duct 14 on the left side will be described, and description of the side face duct 14 on the right side will be omitted, since the side face duct 14 on the right side has the same configuration as the side face duct 14 on the left side except that the side face duct 14 on the right side is on the right side instead of on the left side as illustrated in FIG. 5 and FIG. 6.

The side face duct 14 is configured, such that: an outer heat insulation board 14*b* is arranged outside an inner heat insulation board 14*a* that has been hollowed out in a predetermined shape, the outer heat insulation board 14*b* having an outer diameter dimension that is the same as that of the inner heat insulation board 14*a*; a metal plate member 14*c* is arranged inside the inner heat insulation board 14*a*; and the inner heat insulation board 14*a* is sandwiched between the outer heat insulation board 14*b* and the metal plate member 14*c*. That is, the side face duct 14 is formed by a heat insulating material (heat insulating boards) being processed, the heat insulating material forming a heat insulating structure of the product storage 11, and the hollowed portion of the inner heat insulation board 14*a* forms an air duct 14*a*1.

Figure 9:
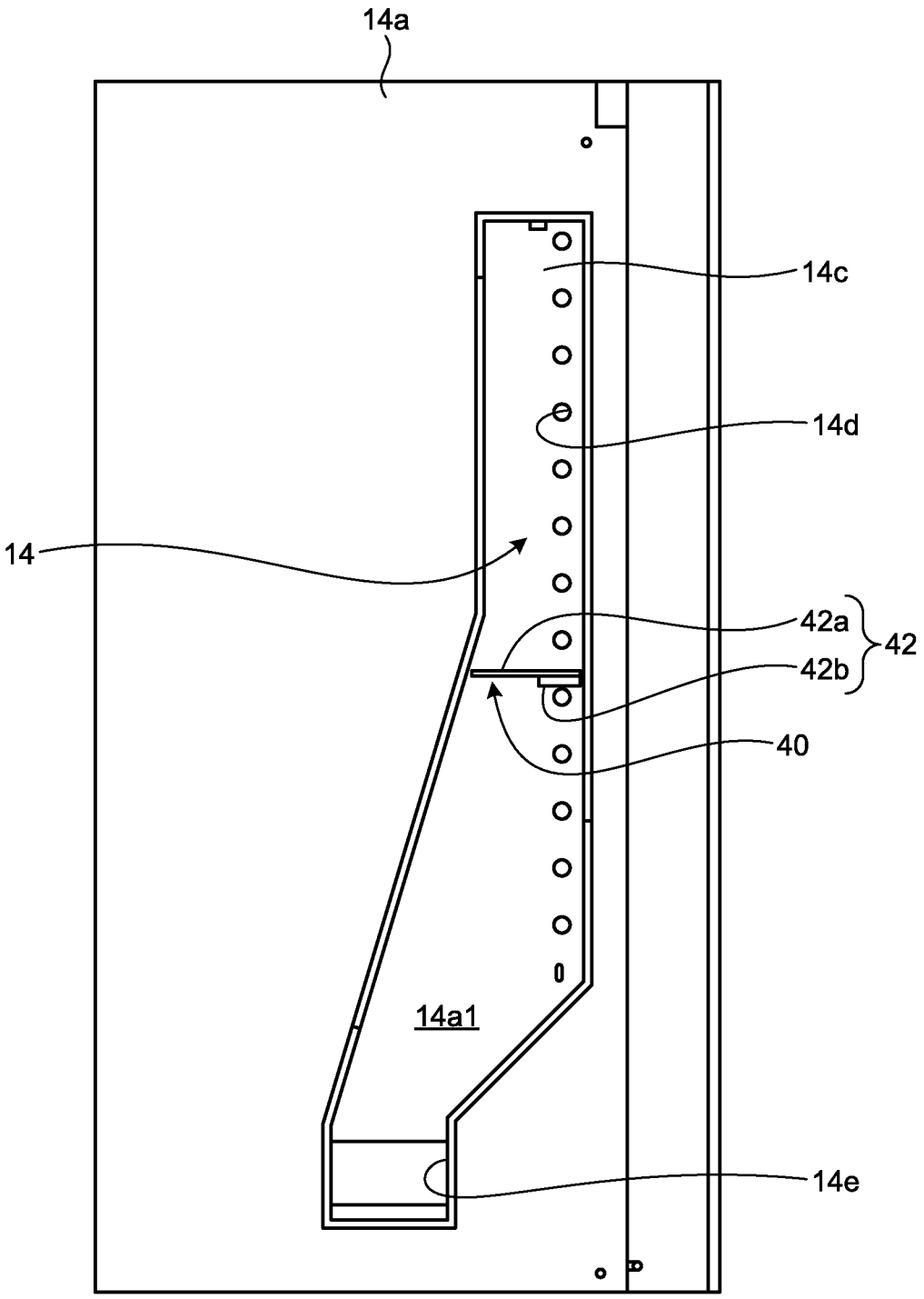
FIG. 9 is a side view illustrating the configuration of the side face duct on the left side illustrated in FIG. 3 as viewed from outside, with illustration of an outer heat insulation board being omitted.

The metal plate member 14*c* has, as illustrated in FIG. 9 also, more than one discharge port 14*d*, which is circular, formed therein, at predetermined intervals, along the up-down direction. Illustration of the outer heat insulation board 14*b* is omitted in FIG. 9.

Figure 10:
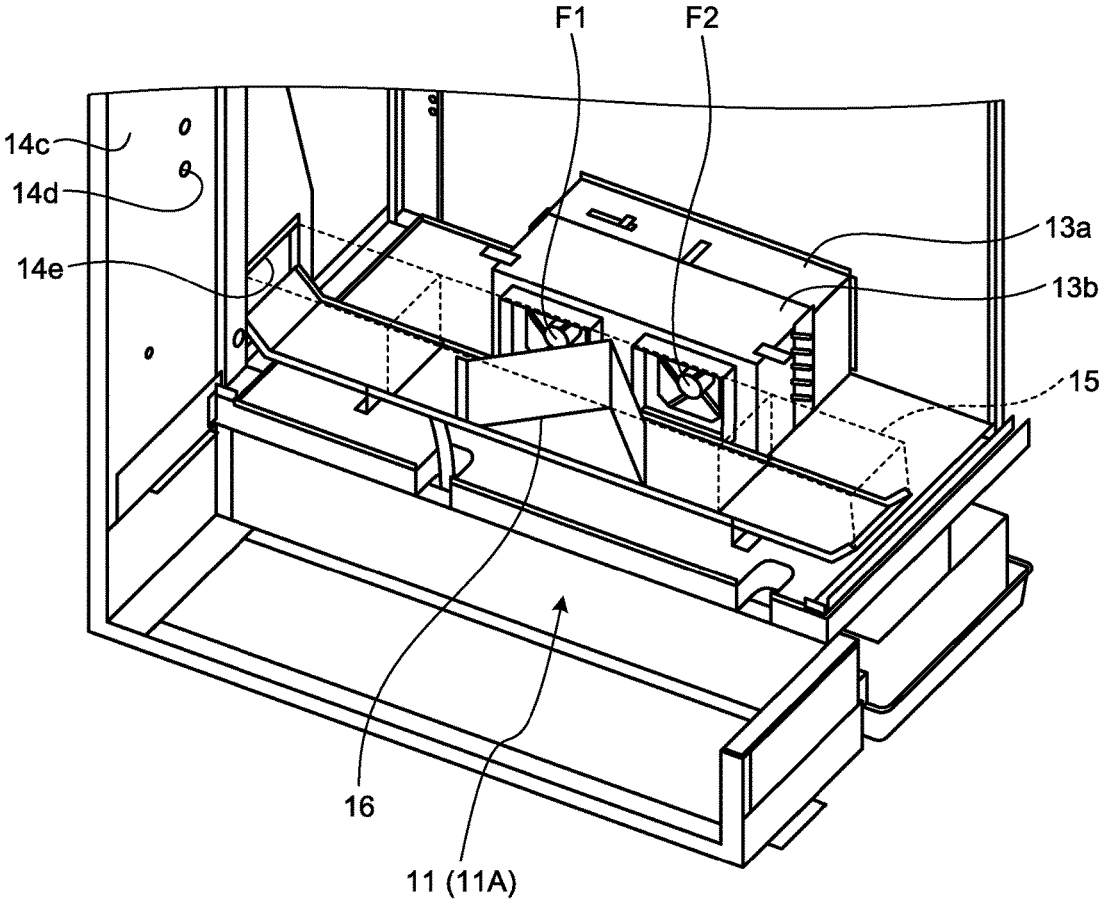
FIG. 10 is a perspective view illustrating a connection wind tunnel member illustrated in FIG. 4.

Further, the metal plate member 14*c* has a communicating opening 14*e*, which communicates with a lower portion of the hollowed portion (air duct 14*a*1) of the inner heat insulation board 14*a* and is rectangular, formed therein. As illustrated in an enlarged view in FIG. 10, this communicating opening 14*e* is covered by a connection wind tunnel member 15. The connection wind tunnel member 15 is a box-shaped member that extends along the left-right direction, and is for sending out the air that has been sent by the drive of the inner blower fans F1 and F2, that is, the air that has been cooled by the evaporator 13*b*, to the side face duct 14.

As described above, the side face duct 14 communicates with the back face duct 13 through the connection wind tunnel member 15, the evaporator 13*b*, and the wind tunnel member 13*a*. A flow dividing member 16, which is V-shaped, is arranged inside this connection wind tunnel member 15. The flow dividing member 16 is formed by a steel plate being bent, and is for dividing and sending out flow of air to the left and the right, the air having been fed by the drive of the inner blower fans F1 and F2.

The hollowed portion (air duct 14*a*1) of the inner heat insulation board 14*a* forming the side face duct 14 is formed such that width of an upper side thereof is narrower than width of a lower side thereof. Thereby, cross sectional area of the air duct 14*a*1 of the side face duct 14 on the left side decreases upward up to a predetermined position in a height direction of the side face duct 14, and above that position in the height direction of the side face duct 14, the cross sectional area is maintained. Thereby, flow velocity of air discharged from the respective discharge ports 14*d* of the side face duct 14 is able to be made substantially uniform.

In the above described configuration, by the drive of the inner blower fans F1 and F2, the inside air that has flown into the back face duct 13 through the respective air inlets 13*c* is blown out from the air outlet and cooled by the evaporator 13*b*. The air that has been cooled by the evaporator 13*b* reaches the connection wind tunnel member 15, flow of the air is divided to the left and the right by the flow dividing member 16, and the divided air enters the respective side face ducts 14. The inside air that has entered the side face ducts 14 passes therethrough upward, is blown out at a substantially uniform wind velocity from the respective discharge ports 14*d*, and is discharged to a front region including the front end portions of the product storage shelves 12. Thereby, the inside air that has been discharged from the respective discharge ports 14*d* circulates inside and outside the product storage region 11A such that, as illustrated with arrows in FIG. 3, the inside air: passes backward after substantially spreading over the front region; and is drawn into the back face duct 13 through the air inlets 13*c*.

Figure 11:
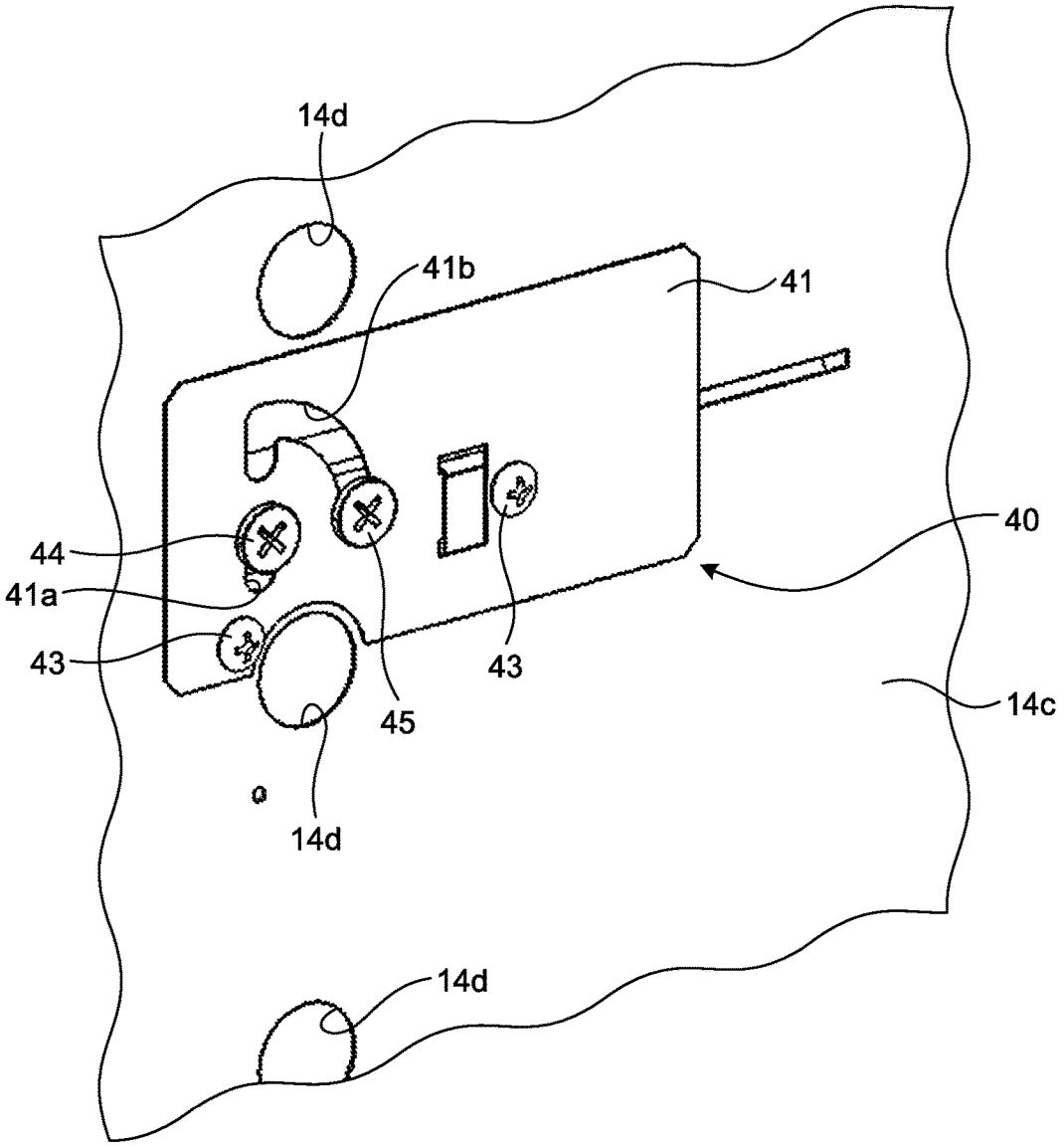
FIG. 11 is a perspective view illustrating a restriction mechanism illustrated in FIG. 4 to FIG. 6 as viewed from inside.
Figure 12:
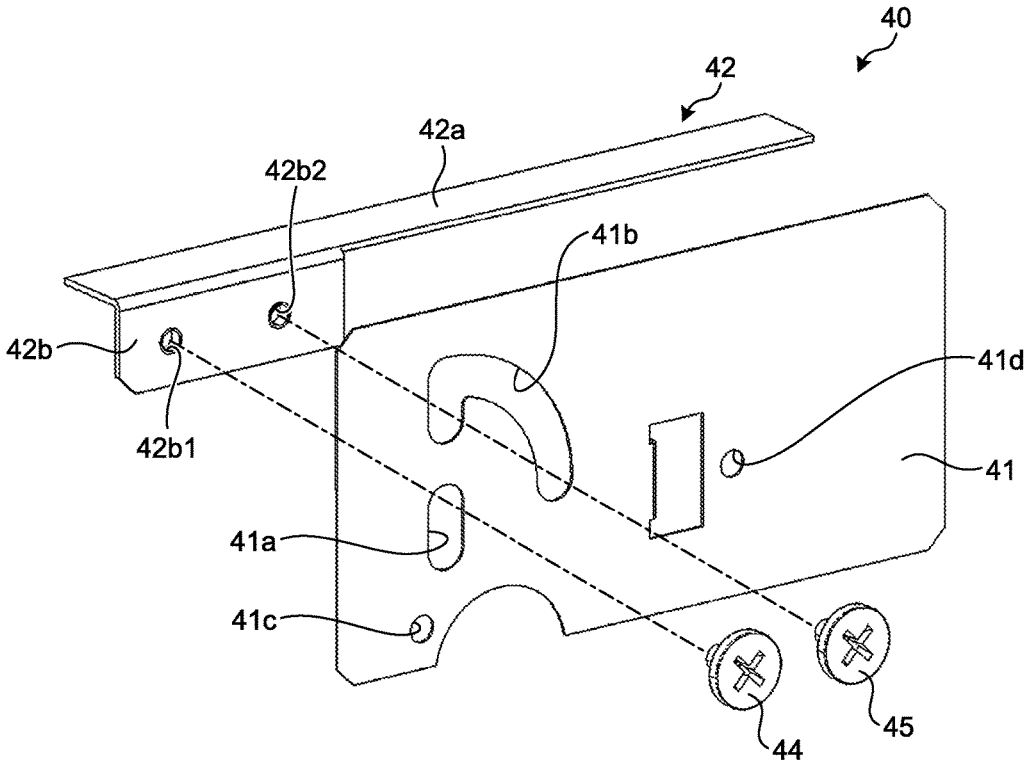
FIG. 12 is an exploded perspective view of the restriction mechanism illustrated in FIG. 4 to FIG. 6.

As illustrated in FIG. 4 to FIG. 6, each of the side face ducts 14 has a restriction mechanism 40 provided therein. FIG. 11 and FIG. 12 each illustrate the restriction mechanism 40 illustrated in FIG. 4 to FIG. 6, FIG. 11 is a perspective view thereof as viewed from inside the storage, and FIG. 12 is an exploded perspective view thereof.

The restriction mechanisms 40 are in a pair of left and right restriction mechanisms provided in the respective side face ducts 14, and as illustrated in FIG. 11 and FIG. 12 also, each of the restriction mechanisms 40 is configured to include a restriction support portion 41 and a restriction piece unit 42.

The restriction support portion 41 is a sheet-like member formed of, for example, a steel sheet. This restriction support portion 41 has a first support hole 41*a* and a second support hole 41*b*, formed therein.

The first support hole 41*a* is formed at a front end side of the restriction support portion 41, and is a long hole with the up-down direction being a longitudinal direction thereof. The second support hole 41*b* is a deformed long hole formed in a curved shape so as to extend along the up-down direction above the first support hole 41*a*, and to be inclined gradually downward from an upper end extended portion thereof backward.

This restriction support portion 41 is attached on the metal plate member 14*c* at a predetermined position in a height direction of the metal plate member 14*c* by fastening screws 43 being fastened to the metal plate member 14*c*, the fastening screws 43 respectively penetrating through attachment holes 41*c* and 41*d* from the inside, the attachment holes 41*c* and 41*d* having been formed below the first support hole 41*a* and behind the second support hole 41*b*.

The restriction piece unit 42 is formed of, for example, a steel plate, and has an acting portion 42*a* and a proximal portion 42*b*. The acting portion 42*a* is, in the example of FIG. 11 and FIG. 12, a long flat plate shaped member with the front-back direction being a longitudinal direction thereof. When the longitudinal direction is the front-back direction, this acting portion 42*a* has a size that is able to substantially block the air duct 14*a*1. The proximal portion 42*b* is, in the example of FIG. 11 and FIG. 12, a flat plate shaped part that extends downward from an inner end portion of a front end portion of the acting portion 42*a*. This proximal portion 42*b* has two screw holes 42*b*1 and 42*b*2 formed therein. In the example of FIG. 11 and FIG. 12, the screw hole 42*b*1 in the front is also referred to as "first screw hole 42*b*1", and the screw hole 42*b*2 at the back is also referred to as "second screw hole 42*b*2".

The restriction piece unit 42 is supported on the restriction support portion 41 by: a first stepped screw 44 being screwed into the first screw hole 42*b*1, and a second stepped screw 45 being screwed into the second screw hole 42*b*2, the first stepped screw 44 penetrating through the first support hole 41*a* from the inside, the second stepped screw 45 penetrating through the second support hole 41*b* from the inside, in a state where the metal plate member 14*c* has been interposed between the restriction piece unit 42 and the restriction support portion 41.

By displacement of the second stepped screw 45 along the extending direction of the second support hole 41*b*, the restriction piece unit 42 is able to swing in the up-down direction with respect to the restriction support portion 41 around a central axis of the first stepped screw 44.

Figure 13:
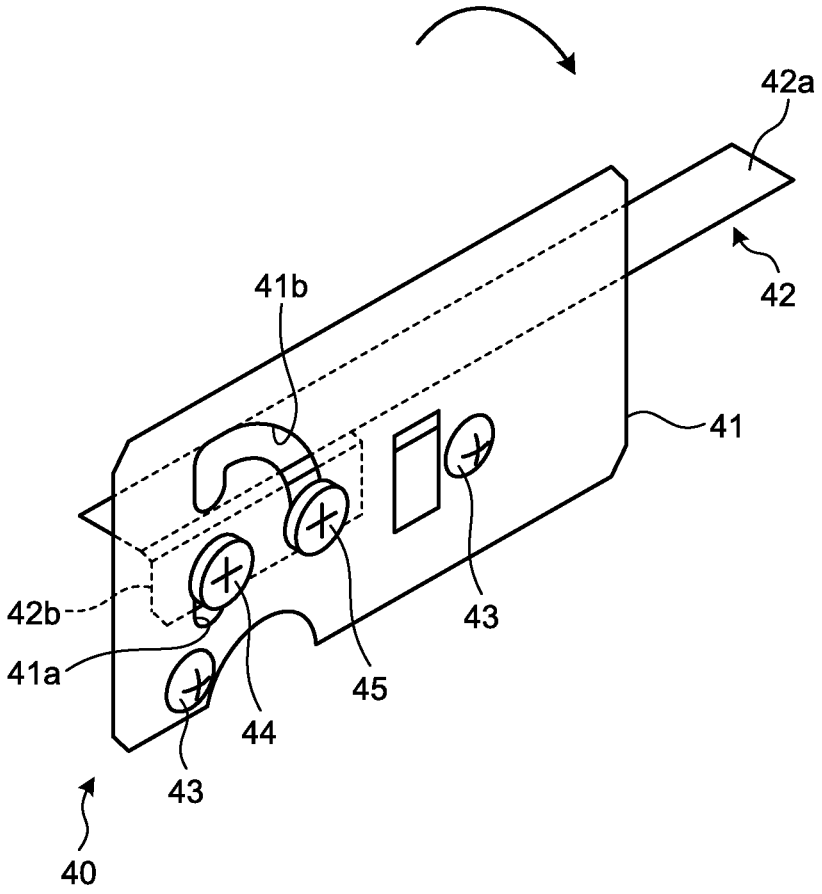
FIG. 13 is a perspective view of the restriction mechanism illustrated in FIG. 11 and FIG. 12 in a closed state.
Figure 14:
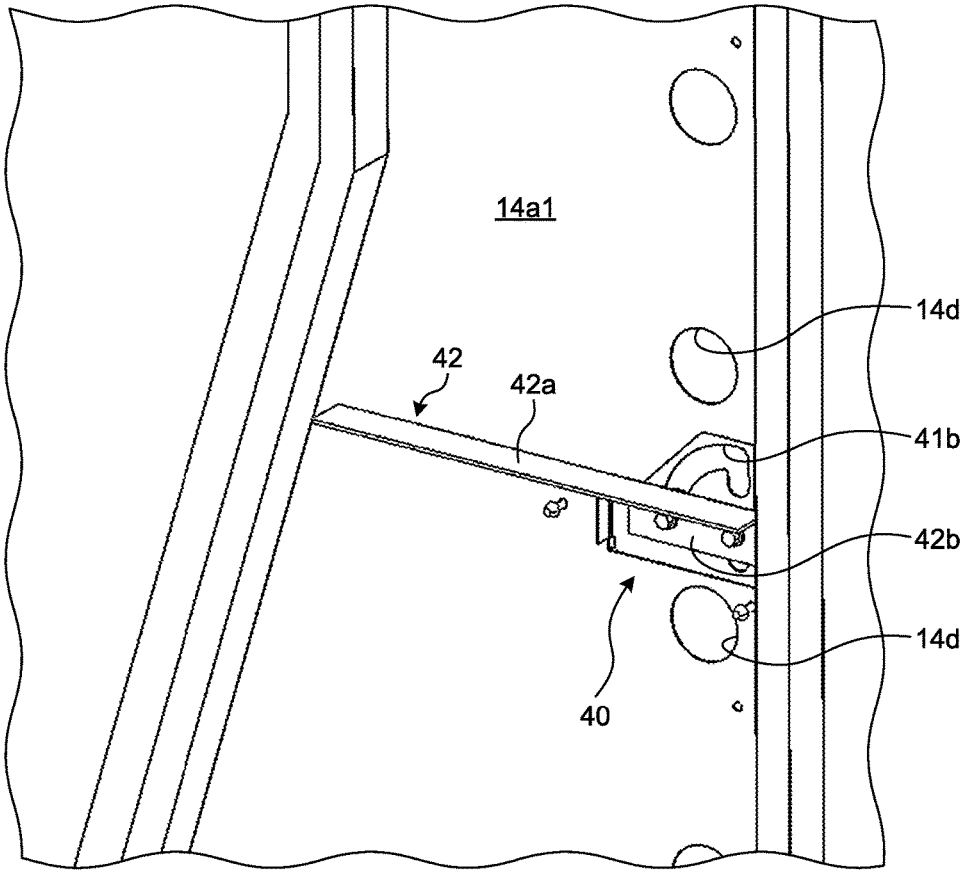
FIG. 14 is an enlarged perspective view illustrating a state where the side face duct (air passage) is closed, when the restriction mechanism illustrated in FIG. 11

As illustrated in FIG. 13, by the first stepped screw 44 penetrating through an upper end portion of the first support hole 41*a* and the second stepped screw 45 penetrating through a back end portion of the second support hole 41*b*, this restriction mechanism 40 is brought into a closed state where the acting portion 42*a* of the restriction piece unit 42 extends along the front-back direction. In this closed state, as illustrated in FIG. 14, the restriction piece unit 42 (acting portion 42*a*) substantially blocks the air duct 14*a*1.

Figure 15:
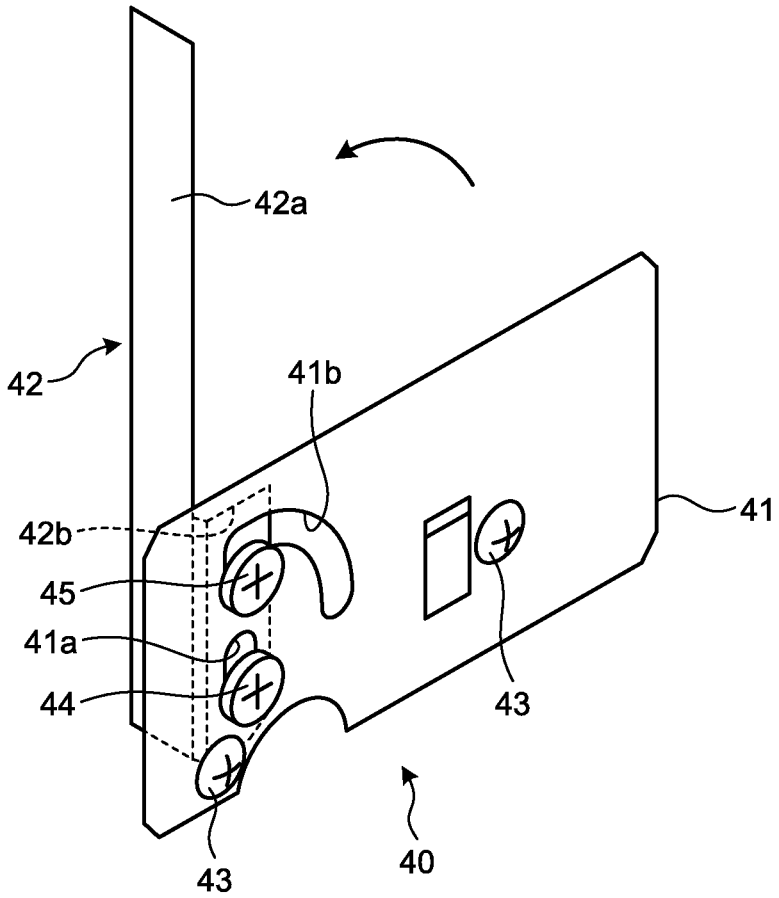
FIG. 15 is a perspective view of the restriction mechanism illustrated in FIG. 11 and FIG. 12 in an open state.

By the restriction piece unit 42 being swung upward around the central axis of the first stepped screw 44 from the closed state such that the second stepped screw 45 is displaced forward in the second support hole 41*b*; as illustrated in FIG. 15, the first stepped screw 44 penetrates through a lower end portion of the first support hole 41*a*, the second stepped screw 45 penetrates through a front end portion of the second support hole 41*b*, and thereby the restriction mechanism 40 is brought into an open state where the acting portion 42*a* of the restriction piece unit 42 extends along the up-down direction. In this open state, the restriction piece unit 42 opens the air duct 14*a*1 that the restriction piece unit 42 has been substantially blocking in the closed state.

As described above, in the open state, by opening the air duct 14*a*1, the restriction mechanism 40 allows the inside air to be discharged from the discharge ports 14*d* (target discharge ports 14*d*) that are higher than the position in the height direction of the side face duct 14 where the restriction mechanism 40 has been arranged; while in the closed state, the restriction mechanism 40 restricts the inside air from being discharged from the target discharge ports 14*d* by substantially blocking the air duct 14*a*1.

In the above described automatic vending machine according to the embodiment, when the pair of left and right restriction mechanisms 40 is in the open state, by the drive of the inner blower fans F1 and F2, the inside air that has flown into the back face duct 13 through the respective air inlets 13*c* is caused to enter each of the side face ducts 14, and the inside air is caused to be discharged from the respective discharge ports 14*d* at a substantially uniform wind velocity; thereby, the inside air is circulated inside and outside the product storage region 11A such that the discharged inside air passes backward after substantially spreading over the front region including the front end portions of the product storage shelves 12 and flows into the back face duct 13 from the air inlets 13*c*; and thus, products at the back of the respective product storage shelves 12 are also able to be cooled well while the frontmost products on the respective product storage shelves 12 are infallibly cooled to a desired temperature.

When the pair of left and right restriction mechanisms 40 is in the closed state, by the drive of the inner blower fans F1 and F2, the inside air is circulated inside and outside the product storage region 11A such that the inside air that has entered the respective side face ducts 14 from the back face duct 13 is caused to be discharged from the discharge ports 14*d* lower than the restriction mechanisms 40 and the discharged inside air passes backward after substantially covering the front region including the front end portions of the product storage shelves 12 lower than the restriction mechanism 40 and flows into the back face duct 13 from the air inlets 13*c*; and thus the product storage region 11A is able to be divided into two temperature zones at the position in the height direction of the side face duct 14 where the restriction mechanisms 40 are provided. That is, a region lower than the restriction mechanisms 40 is able to be made a cooled region, and a region higher than the restriction mechanisms 40 is able to be made a cool region higher in temperature than the cooled region.

Therefore, the automatic vending machine enables the product storage region 11A to be cooled into a single temperature zone when the restriction mechanisms 40 are in the open state, and the product storage region 11A to be cooled into two temperature zones when the restriction mechanisms 40 are in the closed state; and thus, enables products on the product storage shelves 12 to be sold at more than one temperature zone as necessary.

A preferred embodiment of the disclosure has been described above, but the disclosure is not limited to this embodiment, and various modifications may be made.

Figure 16:
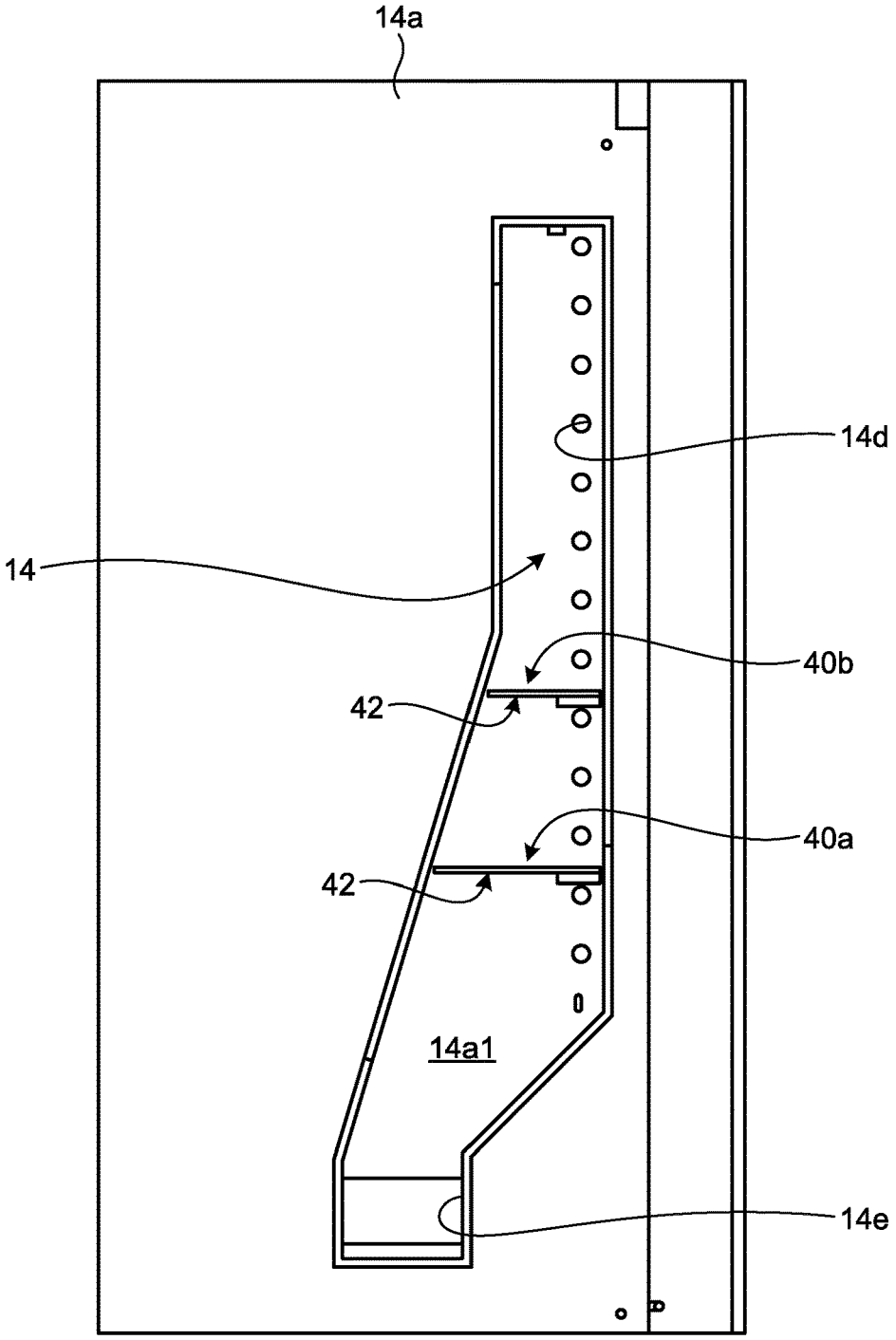
FIG. 16 is a side view of a configuration of a side face duct forming a modified example of the automatic vending machine that is the embodiment of the disclosure when the side face duct is viewed from outside, with illustration of an outer heat insulation board being omitted.
Figure 17:
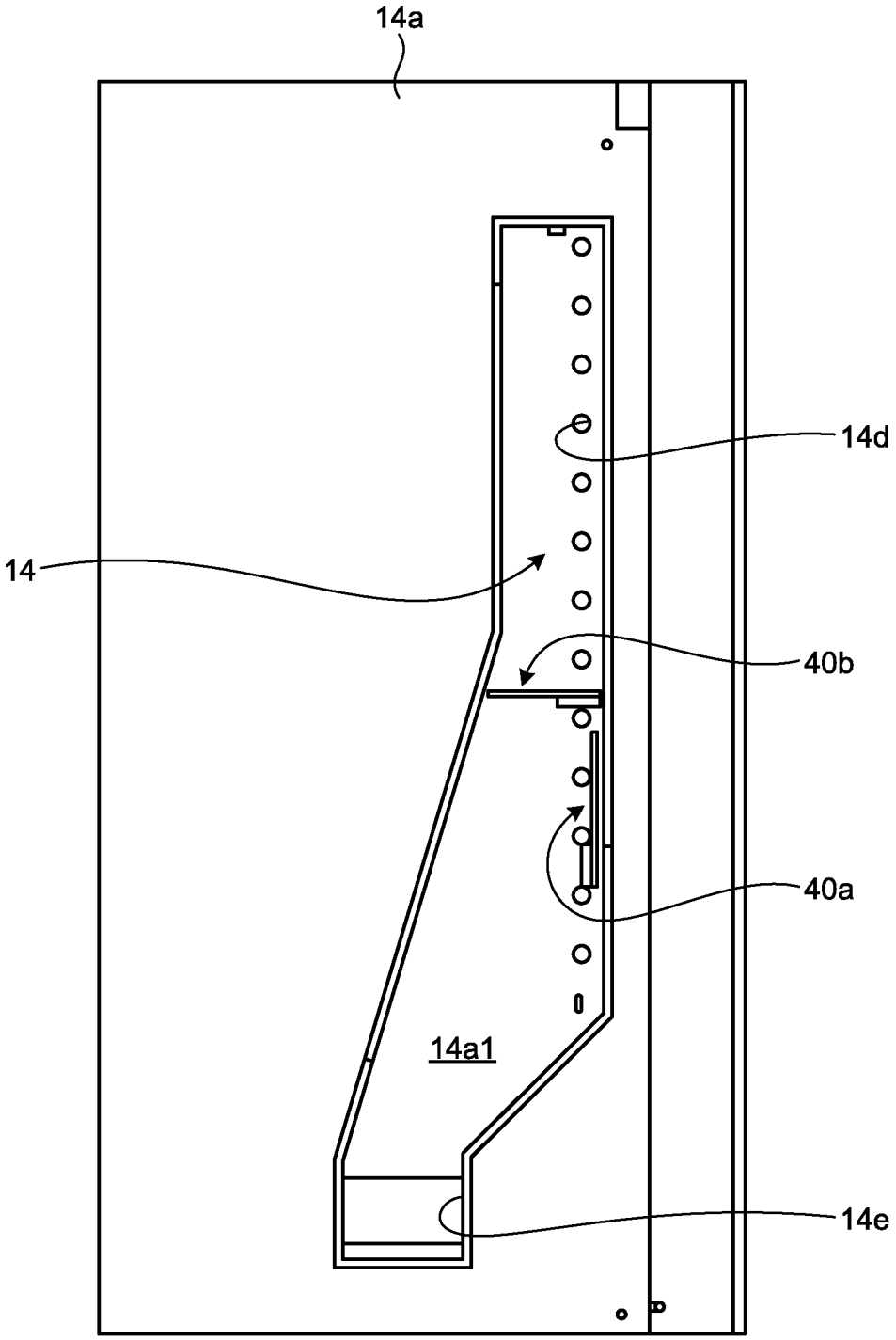
FIG. 17 is a side view of the configuration of the side face duct forming the modified example of the automatic vending machine that is the embodiment of the disclosure when the side face duct is viewed from outside, with illustration of the outer heat insulation board being omitted.
Figure 18:
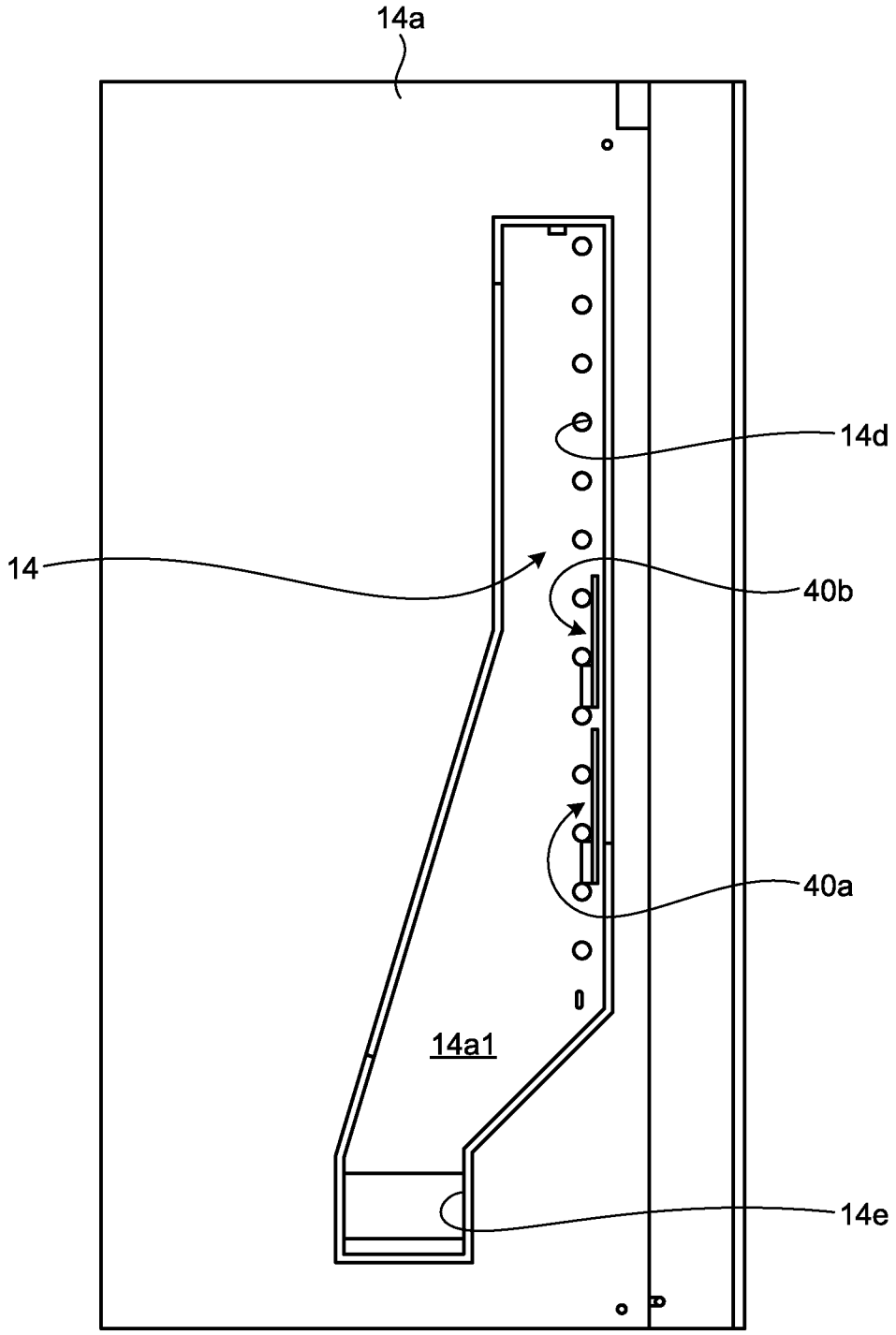
FIG. 18 is a side view of the configuration of the side face duct forming the modified example of the automatic vending machine that is the embodiment of the disclosure when the side face duct is viewed from outside, with illustration of the outer heat insulation board being omitted.

In the above described embodiment, an example, in which the restriction mechanism 40 is provided singly in each of the side face ducts 14, has been described, but according to the disclosure, as illustrated in FIG. 16 to FIG. 18, plural (in the illustrated example, two) restriction mechanisms 40*a* and 40*b* may be provided at different positions in the height direction of the side face duct 14 in each of the side face ducts 14. That is, in the side face ducts 14, pairs of left and right restriction mechanism 40*a* and 40*b* may be provided at different positions in the height direction of the side face duct 14. In FIG. 16 to FIG. 18, the restriction mechanisms 40*a* and 40*b* provided in the side face duct 14 on the left side are illustrated, and similarly to FIG. 9, illustration of the outer heat insulation board 14*b* has been omitted therein.

By all of the restriction mechanisms 40*a* and 40*b* being brought into the closed state as illustrated in FIG. 16, the product storage region 11A is able to be divided into two temperature zones at the position in the height direction of the side face duct 14 where the lower restriction mechanisms 40*a* are arranged. Further, by the lower restriction mechanisms 40*a* being brought into the open state, and the upper restriction mechanisms 40*b* being brought into the closed state, as illustrated in FIG. 17; the product storage region 11A is able to be divided into two temperature zones at the position in the height direction of the side face duct 14 where the upper restriction mechanisms 40*b* are arranged. Furthermore, by all of the restriction mechanisms 40*a* and 40*b* being brought into the open state as illustrated in FIG. 18, the product storage region 11A is able to be cooled into a single temperature zone.

In the above described embodiment, the restriction mechanisms 40 are provided in a pair of left and right restriction mechanisms in the respective side face ducts 14, but according to the disclosure, as long as the amount of discharged wind from the discharge ports 14*d* is able to be obtained sufficiently, the side face duct 14 may be provided on either one of the left side and the right side, and in this case, the restriction mechanism just needs to be provided in that side face duct 14 only.

In the above described embodiment, the air that has entered the side face ducts 14 passes upward, but according to the disclosure, a configuration, in which the air that has entered the side face ducts 14 passes downward, may be adopted.

In the above described embodiment, the restriction mechanisms 40 are provided to open and close the air ducts 14*a*1 of the side face ducts 14, but according to the disclosure, restriction mechanisms may be provided to open and close discharge ports 14*d* of side face ducts 14. Further, according to the disclosure, a back face side restriction mechanism may be provided in a back face duct 13. In an open state thereof, this back face side restriction mechanism allows inside air to be drawn in from some air inlets (which may, hereinafter, be referred to as "target air inlets") of air inlets 13*c*, the some air inlets being higher than a position in the height direction of the side face duct 14 where the above described restriction mechanisms 40 are arranged, while in a closed state thereof, restricting the inside air from being drawn in from the target air inlets. This back face side restriction mechanism is brought into the open state when the above described restriction mechanisms 40 are in the open state, and is brought into the closed state when the above described restriction mechanisms 49 are in the closed state. Accordingly, when both the above described restriction mechanisms 40 and the back face side restriction mechanism are in the closed states; on the upper side of a predetermined position in the height direction of the side face duct 14, drawing of the inside air from the target air inlets and discharge of the air from the target discharge ports are restricted, and the product storage region is able to be divided into more than one temperature zone infallibly.

According to some embodiments, when the restriction mechanisms are in the open state, the restriction mechanisms allow the inside air to be discharged from the target discharge ports of the discharge ports, the target discharge ports being positioned downstream of air flow in the side face duct with respect to a predetermined position in a height direction of the side face duct; and thus the circulating unit enables the inside air to be discharged to the front region including the front end portions of the product storage shelves from the target discharge ports and the discharge ports upstream of the target discharge ports. When the restriction mechanisms are in the closed state, the restriction mechanisms restrict the inside air from being discharged from the target discharge ports; and thus the circulating unit enables the inside air to be discharged to the front region including the front end portions of the product storage shelves from the discharge ports upstream of the target discharge ports, and the product storage region is able to be divided into two temperature zones at the predetermined position in the height direction of the side face duct. Therefore, an effect of being able to sell products on product storage shelves at more than one temperature zone as necessary is achieved.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An automatic vending machine, comprising:

product storage shelves that are provided along an up-down direction in a product storage region inside a product storage defined in a main body of the automatic vending machine;

a back face duct configured to extend along the up-down direction behind the product storage region;

a circulating unit configured to flow air inside the product storage into the back face duct from an air inlet of the back face duct to circulate the inside air between an inside of the product storage region and an outside of the product storage region;

a temperature adjusting unit configured to adjust the inside air circulated by the circulating unit to a desired temperature; and a side face duct configured to extend along the up-down direction at a place corresponding to front end portions of the product storage shelves in at least one of both side regions of the product storage region, and communicate with the back face duct, wherein the circulating unit is configured to circulate the inside air by causing the inside air that has flown into the back face duct to enter the side face duct, and causing the inside air to be discharged to a front region including the front end portions of the product storage shelves from discharge ports provided at predetermined intervals along an extending direction of the side face duct, such that the discharged inside air passes backward after substantially spreading over the front region and flows into the back face duct from the air inlet, and the automatic vending machine further comprises a restriction mechanism provided in the side face duct, and including a restriction support portion and a restriction piece unit, the restriction mechanism having an open state where the restriction piece is arranged along the up-down direction and a closed state where the restriction piece unit is disposed on the restriction support portion and extends along the front-back direction so that the restriction mechanism is configured to:

allow the inside air to be discharged from target discharge ports of the discharge ports when the restriction mechanism is in the open state, the target discharge ports being positioned downstream of air flow in the side face duct with respect to a predetermined position in a height direction of the side face duct; and restrict the inside air from being discharged from the target discharge ports when the restriction mechanism is in the closed state.

2. The automatic vending machine according to claim 1, wherein the side face duct includes a pair of left and right side face ducts extending along the up-down direction in both of the side regions of the product storage region, and the restriction mechanism includes a pair of left and right restriction mechanisms at the predetermined position in the respective side face ducts.

3. The automatic vending machine according to claim 2, wherein the side face duct has an air duct where the inside air passes, the air duct having a cross sectional area that decreases upward.

4. The automatic vending machine according to claim 1, wherein the side face duct has an air duct where the inside air passes, the air duct having a cross sectional area that decreases upward.

5. The automatic vending machine according to claim 1, wherein the restriction piece unit is a flat plate shaped member attached to the restriction support portion such that the restriction piece unit rotates relative to the restriction support portion between the open state and the closed state.

6. An automatic vending machine, comprising:

product storage shelves that are provided along an up-down direction in a product storage region inside a product storage defined in a main body of the automatic vending machine;

a back face duct configured to extend along the up-down direction behind the product storage region;

a circulating unit configured to flow air inside the product storage into the back face duct from an air inlet of the back face duct to circulate the inside air between an inside of the product storage region and an outside of the product storage region;

a temperature adjusting unit configured to adjust the inside air circulated by the circulating unit to a desired temperature; and a side face duct configured to extend along the up-down direction at a place corresponding to front end portions of the product storage shelves in at least one of both side regions of the product storage region, and communicate with the back face duct, wherein the circulating unit is configured to circulate the inside air by causing the inside air that has flown into the back face duct to enter the side face duct, and causing the inside air to be discharged to a front region including the front end portions of the product storage shelves from discharge ports provided at predetermined intervals along an extending direction of the side face duct, such that the discharged inside air passes backward after substantially spreading over the front region and flows into the back face duct from the air inlet, and the automatic vending machine further comprises a restriction mechanism configured to:

allow the inside air to be discharged from target discharge ports of the discharge ports when the restriction mechanism is in an open state, the target discharge ports being positioned downstream of air flow in the side face duct with respect to a predetermined position in a height direction of the side face duct;

restrict the inside air from being discharged from the target discharge ports when the restriction mechanism is in a closed state, and a flow dividing member that is provided in a part communicating the back face duct with the side face ducts, the flow dividing member being configured to divide flow of the inside air discharged from the back face duct into left and right flows to flow the inside air into the respective side face ducts.

7. The automatic vending machine according to claim 6, wherein the side face duct has an air duct where the inside air passes, the air duct having a cross sectional area that decreases upward.

* * * * *